US008710382B2

(12) United States Patent
Huang

(10) Patent No.: US 8,710,382 B2
(45) Date of Patent: Apr. 29, 2014

(54) KEYPAD ASSEMBLY FOR ELECTRONIC DEVICES

(75) Inventor: Xian-Wu Huang, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 277 days.

(21) Appl. No.: 13/223,274

(22) Filed: Aug. 31, 2011

(65) Prior Publication Data

US 2012/0318655 A1 Dec. 20, 2012

(30) Foreign Application Priority Data

Jun. 20, 2011 (CN) ..... 2011 1 0165781

(51) Int. Cl.
*H01H 9/26* (2006.01)

(52) U.S. Cl.
USPC ..... 200/5 A

(58) Field of Classification Search
USPC ..... 200/5 A, 310–314, 317, 341, 510–520, 200/344–345
See application file for complete search history.

(56) References Cited

U.S. PATENT DOCUMENTS

| | | | | |
|---|---|---|---|---|
| 2007/0272534 | A1* | 11/2007 | Iohara | 200/512 |
| 2008/0283375 | A1* | 11/2008 | Iohara | 200/296 |
| 2010/0018848 | A1* | 1/2010 | Cao | 200/5 A |
| 2010/0326807 | A1* | 12/2010 | Zhu | 200/5 A |
| 2011/0024277 | A1* | 2/2011 | Chen et al. | 200/5 A |

* cited by examiner

*Primary Examiner* — Edwin A. Leon
(74) *Attorney, Agent, or Firm* — Novak Druce Connolly Bove + Quigg LLP

(57) ABSTRACT

A key pad assembly includes a keypad and a shading sheet. The keypad includes a board and a plurality of supporting portions formed on and protruding from the board, each supporting portion has an end surface for pressing and sidewalls surrounding and connecting to the end surface and the board. The shading plate includes a base sheet attaching to and shading the board and a plurality of shading cavities formed on the base sheet, the shading cavities surrounds and shades the corresponding supporting portions while allowing light to pass through the end surface.

18 Claims, 4 Drawing Sheets

KEYPAD ASSEMBLY FOR ELECTRONIC DEVICES

BACKGROUND

1. Technical Field

The present disclosure generally relates to keypad assemblies, particularly to a keypad assembly to be used for electronic devices.

2. Description of related art

A typical keypad assembly usually includes a number of buttons, a keypad, a dome sheet, a printed circuit board (PCB) and a light guiding plate. The keypad includes a number of key bodies aligning with the buttons. The dome sheet includes a number of elastic contacts aligning with the key bodies. The PCB includes a number of fixed contacts aligning with the elastic contacts and a number of lamps. The light guiding plate is mounted between the dome sheet and the keypad. The light guiding plate guides the light of the lamps to the key bodies of the keypad to illuminate the corresponding buttons.

However, in the typical keypad assembly, light easily escapes from gaps between the buttons.

Therefore, there is room for improvement within the art.

BRIEF DESCRIPTION OF THE DRAWINGS

Many aspects of the disclosed keypad assembly can be better understood with reference to the following drawings. The components in the drawings are not necessarily drawn to scale, the emphasis instead being placed upon clearly illustrating the principles of the present keypad assembly.

DETAILED DESCRIPTION

The disclosed keypad assembly may be applied in portable electronic devices such as mobile phones or personal digital assistants (PDA) in accordance with an exemplary embodiment. In the exemplary embodiment, the keypad assembly being used in a mobile phone is illustrated, although the disclosure is not limited thereto.

Figure 1:
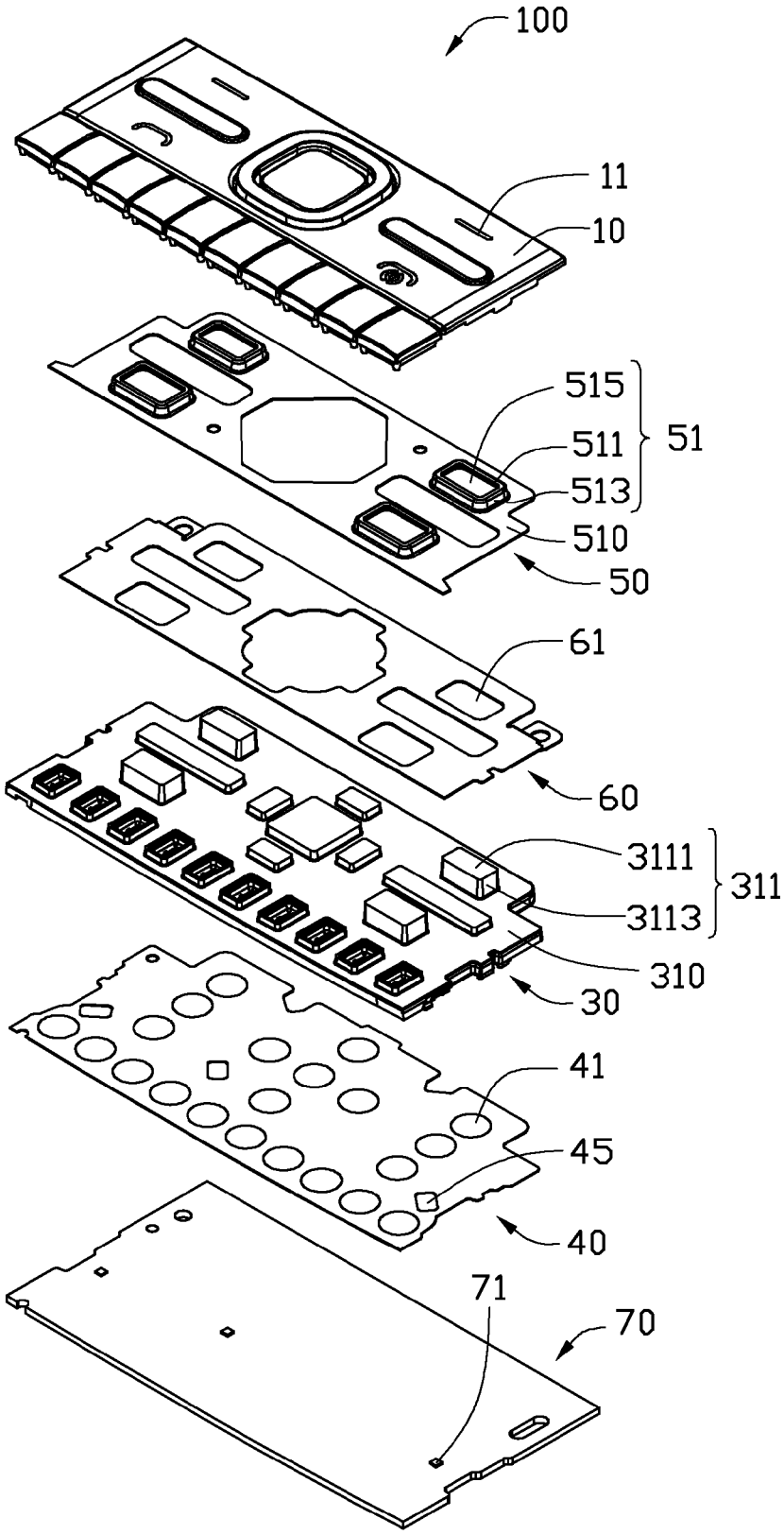
FIG. 1 is an exploded view of a keypad assembly for electronic devices in accordance with an exemplary embodiment.
Figure 2:
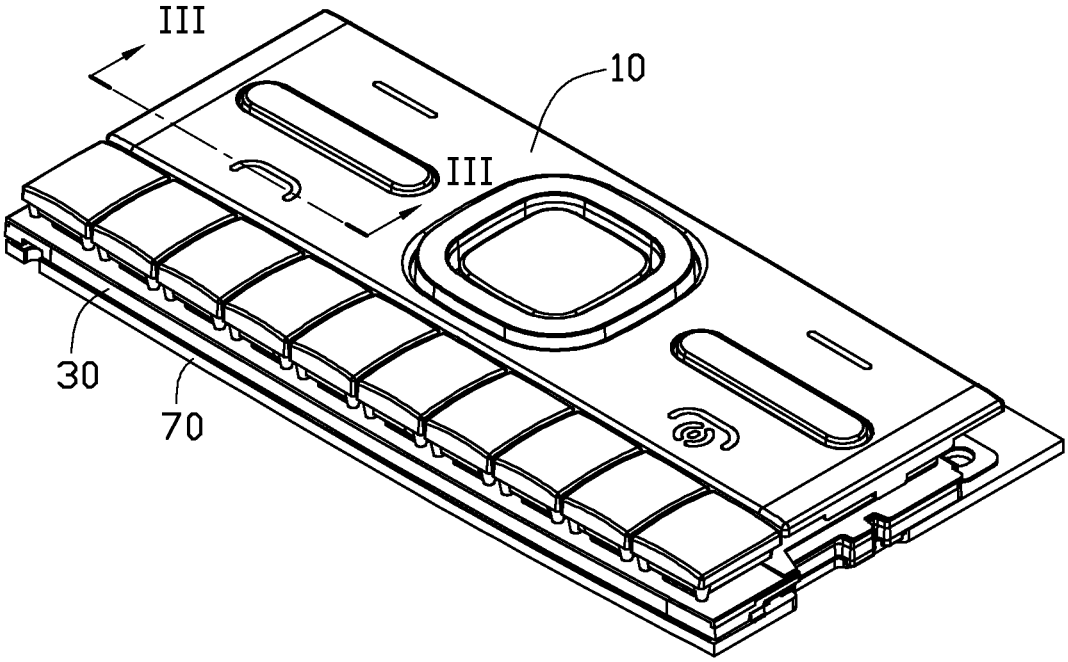
FIG. 2 is an isometric view of the keypad assembly of FIG. 1.
Figure 3:
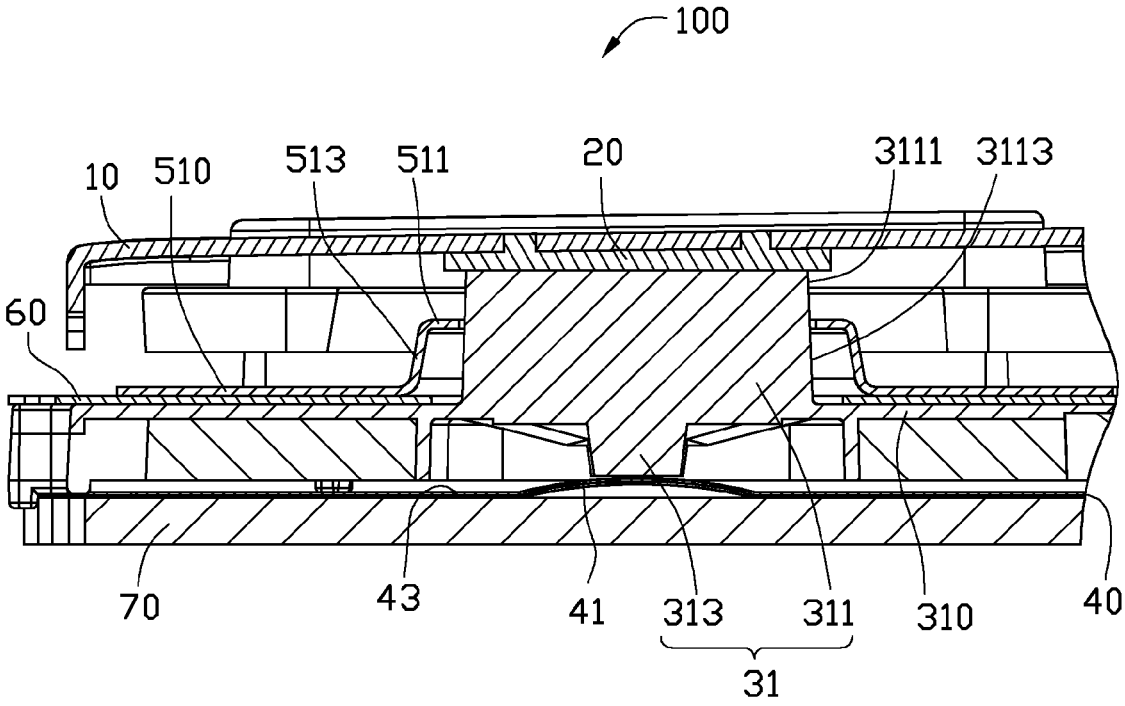
FIG. 3 is a cross sectional view of the keypad assembly of FIG. 1 along line III-III.

Referring to FIGS. 1, 2 and 3, an exemplary embodiment of a keypad assembly 100 is shown. The keypad assembly 100 includes a panel 10, a plurality of buttons 20, a keypad 30, a dome sheet 40, a shading plate 50, a metal sheet 60 and a printed circuit board (PCB) 70.

The panel 10 can be a portion of a housing of the electronic device, or be separately formed and then assembled to the housing. The panel 10 is pressed by users, and has a plurality of patterns 11 locally formed on specific regions of an outer surface of the panel 10 for facilitating users to press the keypad assembly 100. The buttons 20 are mounted on and protrude from an inner (under) surface of the panel 10 and aligning with the corresponding patterns 11.

The keypad 30 is made of light transmitting material. The keypad 30 includes a board 310 and a plurality of key bodies 31 which are formed on the board 310 and arranged corresponding to the buttons 20. Each key body 31 includes a supporting portion 311 and a pressing projection 313 projecting from opposite surfaces of the board 310. Each supporting portion 311 includes an end surface 3111 facing the corresponding button 10, and sidewalls 3113 surrounding and connecting with the end surface 3111 and the board 310. Each pressing projection 313 has a smaller shape and size than that of the corresponding supporting portion 311, and protrudes from a central portion of the supporting portion 311 facing the dome sheet 40.

The dome sheet 40 is mounted on the PCB 70. The dome sheet 40 includes a plurality of dome-shaped elastic contacts 41. The elastic contacts 41 are arranged corresponding to the key bodies 31 of the keypad 30, and a central portion of each elastic contact 41 aligns with a pressing projection 313. The elastic contact 41 deforms and contacts the PCB 70 to trigger an input signal when pressed by the corresponding pressing projection 313. When a specific region of the panel 10 with a pattern 11 is pressed, the corresponding button 20 moves towards and pushes the corresponding supporting portion 311. The corresponding pressing projection 313 moves and presses the corresponding elastic contact 41 to drive the corresponding elastic contact 41 to deform and contact the PCB 70 to trigger an input signal. Then, when the force applied on the panel 10 is released, the elastic contact 41 rebounds to disconnect from the PCB 70 and the keypad 30 and the panel 10 also rebounds to its original state. The dome sheet 40 further includes a plurality of holes 45 defined therein.

A light guiding layer 43 is positioned between the dome sheet 40 and the keypad 30. The light guiding layer 43 can be but not limited to being formed on a surface of the dome sheet 40 from which the elastic contacts 41 are projected by light guiding material coated on the surface of the dome sheet 40.

The PCB 70 includes a plurality of lamps 71. The plurality of holes 45 of the dome sheet 40 are arranged corresponding to the lamps 71, so the lamps 71 can pass through the corresponding holes 45 to be exposed to the light guiding layer 43. The light guiding layer 43 guides the light of the lamps 71 to be uniformly illuminated.

Figure 4:
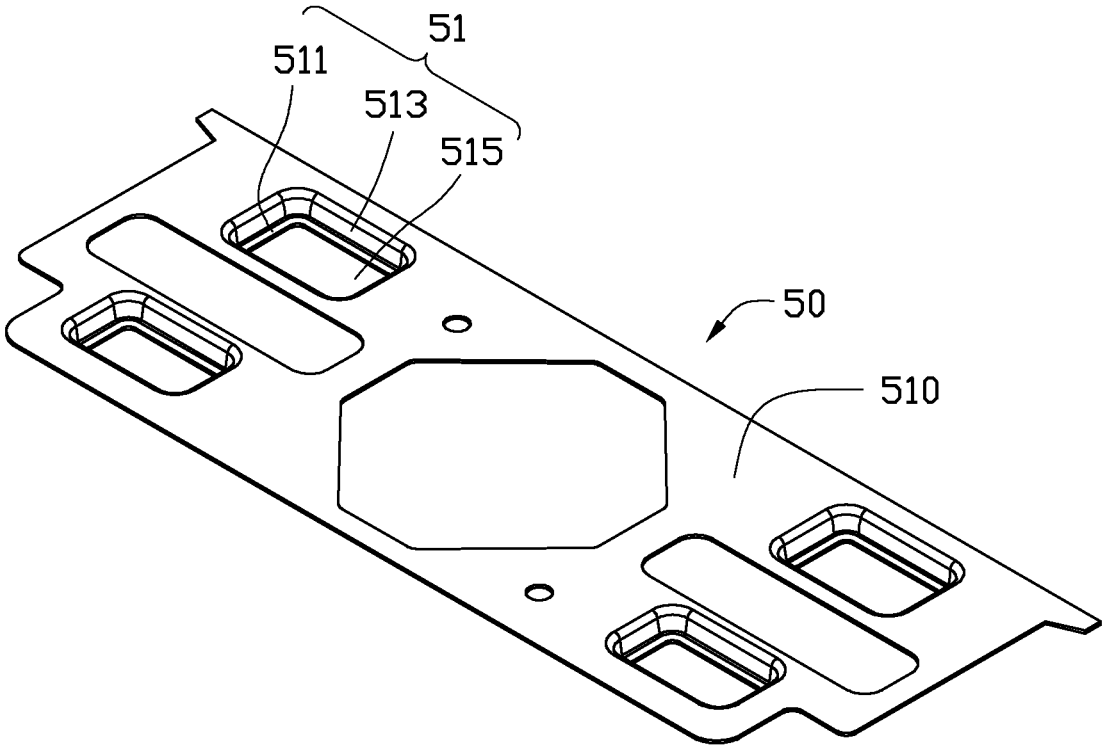
FIG. 4 is an isometric view of a shading plate of the keypad assembly of FIG. 1.

Further referring to FIG. 4, the shading plate 50 is mounted between the keypad 30 and the panel 10, allowing the light of the lamps 71 to pass through the end surfaces 3111 of the supporting portions 313 of the key bodies 31, while preventing the light of lamps 71 from escaping from the other areas of the keypad 30, such as the board 310 and the sidewalls 3113 of the supporting portions 313 of the key bodies 31. The shading plate 50 has a base sheet 510 and a plurality of shading cavities 51 formed on the base sheet 510 for partially surrounding and enclosing the corresponding supporting portions 311. Each shading cavity 51 includes a bottom wall 511, a peripheral wall 513 connecting and surrounding the bottom wall 511 and a through hole 515 defined through the bottom wall 511. The shading plate 50 has a shape and size and arrangement corresponding to that of the keypad 30. So the base sheet 510 can be attached and shade the board 310 and the cavities 51 can substantially shade the supporting portions 311 with the bottom walls 511 surrounding and resisting against the sidewalls 3113 of the supporting portions 311 and the through hole 515 exposing corresponding end surfaces 3111. When the light of the lamps 71 is transmitted to the supporting portion 311, the board 310 and most of the supporting portions 311 are shaded by the shading plate 50, so only the end surface 3111 permits light transmitted therethrough to arrive to the buttons 20 and illuminate the corresponding patterns 11. Therefore, the shading plate 50 can prevent the light from escaping from undesired areas of the keypad 30.

In the exemplary embodiment, the shading sheet 20 is made of Polycarbonate (PC) material. A deep-drawing process forms the shading cavity 51. The height of the peripheral wall 513 can be about 1.2 mm.

The metal sheet 60 is mounted between the shading plate 50 and the keypad 30. The metal sheet 60 is grounded and eliminates static electricity induced from the panel 10 to prevent the PCB 70 from damage from static electricity. The metal sheet 60 includes a plurality of guiding holes 61 defined therethrough and arranged corresponding to the supporting portion 311. The metal sheet 60 has a shape and size corresponding to that of the keypad 30, so that the metal sheet 60 can be attached on the board 310 and the supporting portion 311 can pass through the corresponding guiding hole 61 to face the corresponding button 20.

Referring to FIGS. 1 through 3, the keypad assembly 100 can be but is not limited to be assembled in the following steps. First, the metal sheet 60 is mounted to the keypad 30. The supporting portions 311 align with and pass through the corresponding guiding holes 61 of the metal sheet 60 by attaching the metal sheet 60 on the board 310. Then, the shading plate 50 is attached on the metal sheet 60. The supporting portions 311 are partially surrounded by the corresponding shading cavities 51, and the end surfaces 3111 of the supporting portions 311 are exposed form the corresponding through holes 515. In the next step, the buttons 20 are mounted on the panel 10. The buttons 20 are protruded from an inner (under) surface of the panel 10 and are aligned with corresponding patterns 11. Then, the composite panel 10 is mounted to the composite keypad 30 to enclose the composite keypad 30. The buttons 20 resist against the corresponding supporting portions 311. After that, the dome sheet 40 is mounted on the PCB 70. The lamps 71 are mounted on the PCB 70 pass through the corresponding assembling holes 45 to be exposed to the light guiding layer 43 of the dome sheet 40. Then, the keypad 30 is positioned on the dome sheet 40, and the pressing projections 313 are aligned with a central portion of corresponding elastic contact 41. The assembled process is finished.

In use, the light guiding layer 43 directs light of the lamps 71 to uniformly lighten the keypad 30. Since the shading plate 50 shades the board 310 and most of the supporting portions 311 while allowing light to pass through the end surfaces 3111, only the end surface 3111 permits light transmitted therethrough to arrive at the buttons 20 and illuminates the corresponding patterns 11. Therefore, the shading plate 50 can prevent the light from escaping from undesired areas of the keypad 30.

It is to be understood that, the buttons 20 can be omitted and, accordingly, the key bodies 31 to directly resist against to the inner (under) surface of the panel 10 with the central portions of the key bodies 31 aligning with corresponding patterns 11 of the panel 10.

It is to be understood, however, that even through numerous characteristics and advantages of the present disclosure have been set forth in the foregoing description, together with details of assembly and function, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A keypad assembly comprising:

a keypad comprising a board and a plurality of supporting portions formed on and protruding from the board, each supporting portion having an end surface configured for being pressed and sidewalls surrounding and connecting to the end surface and the board; and a shading plate comprising a base sheet attaching to and shading the board and a plurality of shading cavities formed on the base sheet, the shading cavities surrounding and shading the corresponding supporting portions while allowing light to pass through the end surface;

wherein each shading cavity has a bottom wall, a peripheral wall surrounding the bottom wall and a through hole defined through the bottom wall; the peripheral wall connects the bottom wall with the base sheet, the bottom wall is positioned at a height that is different from the height of the base sheet; the bottom wall surrounds and resists against the sidewalls of the supporting portion and the through hole exposes the corresponding end surface.

2. The keypad assembly as claimed in claim 1, wherein the height of the peripheral wall is about 1.2 millimeters.

3. The keypad assembly as claimed in claim 1, wherein the shading cavity is formed by deep-drawing process.

4. The keypad assembly as claimed in claim 1, wherein the shading plate is made of polycarbonate material.

5. The keypad assembly as claimed in claim 1, further comprising a printed circuit board (PCB) and a dome sheet mounted on the PCB, wherein the dome sheet comprises a plurality of elastic contacts having dome shapes, the elastic contacts are arranged corresponding to the key bodies of the keypad, each key body has a pressing projection projecting toward and aligning with a central portion of the corresponding elastic contact.

6. The keypad assembly as claimed in claim 5, further comprising a plurality of lamps mounted on the PCB, wherein the dome sheet further comprises a plurality of holes defined therein and arranged corresponding to the lamps, the lamps pass through the corresponding holes to be exposed to the surface of the dome sheet.

7. The keypad assembly as claimed in claim 6, further comprising a light guiding layer formed on a surface of the dome sheet from which the elastic contacts being projected by light guiding material coated on the surface of the dome sheet.

8. The keypad assembly as claimed in claim 1, further comprising a metal sheet mounted between the keypad and the shading plate, wherein the metal sheet is grounded to eliminate static electricity induced from the keypad assembly.

9. The keypad assembly as claimed in claim 1, further comprising a plurality of buttons and a panel having a plurality of patterns locally formed on specific regions of an outer surface of the panel for facilitating users to press the keypad assembly, wherein the buttons are mounted on and protrude from an inner surface of the panel aligning with the corresponding patterns.

10. A portable electronic device incorporated with a keypad assembly, the keypad assembly comprising:

a plurality of buttons;

a keypad comprising a board and a plurality of supporting portions formed on and protrude from the board and arranged corresponding to the buttons, each supporting portion having an end surface configured for being pressed by the corresponding button and sidewalls surrounding and connecting to the end surface and the board; and a shading plate comprising a base sheet attaching to and shading the board and a plurality of shading cavities formed on the base sheet, the shading cavities surrounding and shading corresponding supporting portions while allowing light to pass through the end surface;

wherein each shading cavity has a bottom wall, a peripheral wall surrounding the bottom wall and a through hole defined through the bottom wall; the peripheral wall connects the bottom wall with the base sheet, the bottom wall is positioned at a height that is different from the height of the base sheet; the bottom wall surrounds and resists against the sidewalls of the supporting portion and the through hole exposes the corresponding end surface.

11. The portable electronic device as claimed in claim 10, wherein the height of the peripheral wall is about 1.2 millimeters.

12. The portable electronic device as claimed in claim 10, wherein the shading cavity is formed by deep-drawing process.

13. The portable electronic device as claimed in claim 10, wherein the shading plate is made of polycarbonate material.

14. The portable electronic device as claimed in claim 13, further comprising a printed circuit board (PCB) and a dome sheet mounted on the PCB, wherein the dome sheet comprises a plurality of elastic contacts having dome shapes, the elastic contacts are arranged corresponding to the key bodies of the keypad, each key body has a pressing projection projecting toward and aligning with a central portion of the corresponding elastic contact.

15. The portable electronic device as claimed in claim 10, further comprising a plurality of lamps mounted on the PCB, wherein the dome sheet further comprises a plurality of holes defined therein and arranged corresponding to the lamps, the lamps pass through the corresponding holes to be exposed to the surface of the dome sheet.

16. The portable electronic device as claimed in claim 15, further comprising a light guiding layer formed on a surface of the dome sheet from which the elastic contacts being projected by light guiding material coated on the surface of the dome sheet.

17. The portable electronic device as claimed in claim 10, further comprising a metal sheet mounted between the keypad and the shading plate, wherein the metal sheet is grounded to eliminate static electricity induced from the keypad assembly.

18. The portable electronic device as claimed in claim 10, further comprising a panel having a plurality of patterns locally formed on specific regions of an outer surface of the panel for facilitating users to press the keypad assembly, wherein the buttons are mounted on and protrude from an inner surface of the panel aligning with the corresponding patterns.

* * * * *